United States Patent [19]

Hutchinson et al.

[11] 4,432,474

[45] Feb. 21, 1984

[54] HANDLE AND ACTUATING DEVICE FOR PRESSURIZED DISPENSERS

[75] Inventors: Paul Hutchinson; Alan Serginson, both of Acklam, England

[73] Assignee: Can-Gun Limited, Acklam, England

[21] Appl. No.: 279,265

[22] Filed: Jul. 1, 1981

[30] Foreign Application Priority Data

| | | | |
|---|---|---|---|
| Jul. 8, 1980 | [GB] | United Kingdom | 8022233 |
| Sep. 3, 1980 | [GB] | United Kingdom | 8028427 |
| Feb. 3, 1981 | [GB] | United Kingdom | 8103261 |

[51] Int. Cl.[3] ..... B65D 83/14

[52] U.S. Cl. ..... 222/402.15; 222/473

[58] Field of Search ..... 222/402.15, 469, 473, 222/474, 402.13, 472

[56] References Cited

U.S. PATENT DOCUMENTS

| | | | |
|---|---|---|---|
| 3,172,582 | 3/1965 | Belpedio | 222/473 |
| 3,185,351 | 5/1965 | Klun | 222/402.13 X |
| 3,189,232 | 6/1965 | Joffe | 222/402.15 X |
| 4,089,440 | 5/1978 | Lee | 222/402.15 X |

FOREIGN PATENT DOCUMENTS

| | | |
|---|---|---|
| 811619 | 4/1959 | United Kingdom . |
| 829508 | 3/1960 | United Kingdom . |
| 1002216 | 8/1965 | United Kingdom . |
| 1045891 | 10/1966 | United Kingdom . |
| 1163978 | 9/1969 | United Kingdom . |
| 1343881 | 1/1974 | United Kingdom . |
| 1487719 | 10/1977 | United Kingdom . |
| 2001706A | 2/1979 | United Kingdom . |
| 1549917 | 8/1979 | United Kingdom . |
| 2038952A | 7/1980 | United Kingdom . |

*Primary Examiner*—Stanley H. Tollberg

*Attorney, Agent, or Firm*—Larson and Taylor

[57] ABSTRACT

A combined handle and actuating device for pressurized dispensers such as paint spray cans has a body including a handle to be gripped by the user and a means for readily attaching the device to the dispenser. The coupling means may comprise resiliently deformable nose and tail portions which co-operate with a channel in the top of the dispenser. The device includes an actuating means which is operable to depress or release the actuating member or button of the dispenser, and which includes a trigger for operation by the hand of the user.

12 Claims, 4 Drawing Figures

HANDLE AND ACTUATING DEVICE FOR PRESSURIZED DISPENSERS

This invention relates to a combined handle and actuating device for pressurised dispensers.

Pressurised dispensers are well known and widely used. Conventionally they comprise a container for a pressurised active ingredient such as paint, deodorant, weedkiller or insect killer; and a means for permitting release of a spray of the contents of the container in the form of a discharge valve which is manually operable by the depression of an actuating member or button. For short periods of use these cans are particularly convenient and may simply be operated by the index finger of the hand holding the container or can. However where the spray is to be directed for a prolonged period of time this normal operational method can be tiring for the user. Further, where the contents of the can are not particularly pleasant, for example when they are paints or insect sprays, it is often unadvisable to control the spray by means of the finger. Thus it becomes uncomfortable to hold the can and manipulate the valve actuating member, and moreover the contents of the can may impinge on the fingers of the user. In addition, there is often no convenient positive indication of the direction of the spray, nor particularly good control over the release of the spray.

Various devices have been proposed for coupling to pressurised dispensers so as to constitute handles and triggers for operating the dispenser valve. However a problem is that such known devices are not readily coupled to the dispenser. Thus some require rather cumbersome rings in which the dispenser or can must be inserted and secured before use, or simply push onto the outside of the can rim (see, for example GB 1002216 (Johnson) and GB 1487719 (SMRT)). Others such as GB 2038952A (Four Square) may be coupled to the can by means of a so-called snap fit in which a clip portion in the form of a part circular flange is pushed into the outer groove which in conventional dispensers is formed between the upper part of the can and the seal thereof. A snap fit form of attachment is particularly advantageous since this generally permits ready detachment of the device from the dispenser. Thus yet other devices are known which make use of the standard shape and size of the valve assembly of conventional pressurised dispensers as means for coupling to handle/-trigger devices. In standard dispensers the inside surfaces of the rims of the valve assembly are undercut slightly so as to form an annular channel opening towards the push button which, when depressed, actually releases the contents of the can. Some known devices are provided with lugs which may be pressed into the channel so as to enable the device to grip the can, but in general the provision of such lugs has not been found to be satisfactory because the grip provided is not sufficient to permit lifting and manipulation of full cans. Thus GB 2001706A (I to I Plastics Limited) describes a handle attachment wherein resilient lugs engage into the rim of the valve, and are forced outwardly against the rim to provide grip by means of a cam rotatable by a lever. GB 829508 (Donald Josephs Limited) describes a device which is attached to the can by means of an annular formation which is adapted to encircle the valve assembly, and has depending lugs spaced round the annulus which after suitable manoeuvring resiliently engage the channel. Thus there is effectively an outer flange gripping the outside of the valve assembly, and a plurality of lugs gripping the inside of the valve assembly. The flange and lugs are preferably of metal, presumably to provide sufficient strength to grip the full dispenser. GB 1163978 (Müller) describes a similar means of attachment wherein the flange and lugs are constituted by an inner and outer hood. Indeed only the inner hood is stated to be required, in which case attachment is by pressing the device downwardly onto the valve assembly. The inner hood member, which is provided with slits and beads so as to constitute lugs, is then elastically deformed into the channel to grip the can.

The known devices are thus attached by means of a plurality of lugs which either require additional means for ensuring tight attachment, or include a plurality of lugs, often formed separately from the handle, which necessitate careful handling to obtain good coupling. Further, it has been found in practice that a tight snap fit which is easily obtained, strong, and provides ready detachment, is not provided.

It is desirable therefore to provide a device which is easy to attach to the dispenser and can readily be detached therefrom, whilst at the same time providing a strong coupling enabling the can to be lifted and manipulated without danger of detachment. It is further desirable to provide a device which may be produced, with the exception of the trigger, in the form of a single moulding.

According to the present invention there is provided a combined handle and actuating device for a pressurised dispenser of the kind comprising a container containing a pressurised active ingredient and having a discharge valve assembly manually operable by a depressable actuating member, the valve assembly including an annular channel opening towards the actuating member, which device comprises a body including a handle to be gripped by the user and a coupling means adapted for ready supportive attachment to and detachment from the dispenser, and an actuating means operable by the hand of the user holding the handle to depress or release the actuating member, wherein the coupling means comprises a nose portion and a tail portion arranged in spaced relationship and formed to suit substantially diametrically opposed regions of said channel, said nose and tail portions being of a stiffness and at least one of them being of a resilient deformability sufficient to permit supportive attachment of the device to the dispenser by insertion of one of said nose and tail portions into one region of said channel followed by pivotting of the device relative to the dispenser so as to snap engage the other of said nose and tail portions into a substantially diametrically opposed region of the channel.

In a preferred embodiment the actuating means comprises a lever pivotally mounted in the body, one end of the lever extending out of the body to form the trigger and the other end, when the device is attached to the dispenser, engaging the actuating member such that pulling of the trigger causes the lever to pivot and depress the actuating member.

In use of the device, that is when the device is attached to the dispenser, the upward force on the valve actuating member is transmitted through the actuating lever of the device, and so the trigger is maintained in its inoperative position, that is away from the body or handle when the trigger is not actually being pulled by the user. However when the device is not attached to a dispenser the lever may simply pivot freely which means that the trigger may apparently flap loosely between its operative and inoperative positions. Accordingly it is preferred for reasons of appearance so as to present an apparent reactive trigger to the prospective customer, to provide the lever with a spring for reaction against the body of the device so as to maintain the trigger in its inoperative position when the device is not attached to the dispenser and when the trigger is not being pulled by the user. Any convenient form of spring may be used; for example a strip of resilient material may extend from the lever and contact the body to maintain the trigger in the "off" position when pressure is not actually being applied to the trigger, that is when the trigger is not being pulled.

It is a particularly convenient feature of the device that the means for coupling the device to the dispenser is such that the device may readily be attached to and detached from the dispenser.

Attachment is by the insertion and pivotting technique described above; of course detachment is the reverse of this procedure, by snap disengagement of e.g. the tail portion from the channel followed by withdrawal of in this case the nose portion from the opposite region of the channel.

The term supportive attachment as used above means that the coupling means is not only attachable to the dispenser but that when in the attached configuration the coupling is sufficiently strong for the device to support the dispenser i.e. the dispenser can be carried by the handle without the need for other means of support.

The device according to the invention may be formed, for example, of metal. However it is a particularly advantageous feature of one embodiment of the invention that the device is wholly or in part formed from one or more plastics materials such as polypropylene. The use of such materials enables the coupling means to be inherently deformable, although additional means for providing resilient deformation, such as notches or grooves, may be provided where appropriate. Of course the design of the coupling means is such that an opening is provided to permit spray to pass through when the trigger of the device is pulled. This is conveniently provided in a particularly preferred embodiment by the configuration of the nose and tail portions. Thus the tail portion may be considered as an upwardly extending channel having at its base a bead or rim which in use engages in the dispenser, whilst the nose portion may be considered as a cantilever extending from the upper part of the upwardly extending channel and having at its base another bead or rim which again in use engages in the dispenser. The cantilever configuration permits the deformability and resilience which is required in attaching the device to the dispenser, together with the rigidity which gives strength to the device. This is particularly important since the diameter of the inner rim of the valve assembly of standard dispensers may vary by e.g. 0.7 mm and so a range of deformations must be possible to give firm attachment in all cases. Some prior art devices having coupling means comprising a plurality of relatively short lugs are at a disadvantage here since they do not permit the large deformations which are possible with the cantilevered nose and tail coupling of the present invention.

In one particularly preferred form the body is in the form of a one-part plastics moulding of "butterfly" construction, matching sections of the moulding including co-operating portions and being secured together by snap engagement of said co-operating portions. The co-operating portions may be in the form of press-studs which snap together when the "butterfly" is folded along its "spine" or axis of reflection, and are preferably included in the sections which in the folded configuration constitute the handle. This embodiment is particularly advantageous since it enables the device to be produced in only two pieces namely the combined handle and coupling means, and the actuating means, and on a simple two plate tool with no moving side core members. This is thus distinguished from certain prior art devices which are in several pieces and hence require complicated moulding procedures and several stages of assembly.

In another embodiment the body is in the form of a two-part plastics moulding comprising two matching components which include co-operating portions and are secured together by snap engagement of said co-operating portions.

In the above described constructions, the moulding preferably includes a pin disposed in an appropriate position such that it may be used to constitute a pivot point for the actuating means when this is in the form of a pivotted lever. To form the device in the preferred manner, therefore, a butterfly moulding or pair of matching components including an appropriate pin and press-stud portions in the matching handle sections, is formed in a single moulding stage and a lever having a hole to suit the pin is formed in a second moulding. The lever is then fitted over the pin and the matching parts are assembled so that the press-studs snap together, forming a device with the lever pivotted in the body and constituted by an external trigger at one end and another end for actuating the button of the dispenser. If required the press-studs may be of a size such that a standard sized dispenser button may be stored within the handle so that it is conveniently available for putting on a dispenser which does not have a conventionally sized or shaped button.

The nose and tail portions are particularly important features of the invention and may together form a substantially part-annular resiliently deformable member having a lip which suits the channel of the dispenser when the device is attached thereto.

Preferably the side surfaces of the nose and tail portions are flat, e.g. coplanar with the side surfaces of the handle. This configuration has the advantage that ready packaging and stacking of a plurality of devices is permitted. More importantly, though, the flat sides are advantageous since they mean that the device may readily be attached by first inserting, say, the nose portion into the channel without deformation, and then pivoting the device about the nose portion so that the tail portion deforms into and engages the channel. This is distinguished from certain prior art devices which are provided with a plurality of lugs extending substantially annularly about the dispenser actuating member when in the attached configuration, meaning that to attach the device to the dispenser, the lugs must all be fully deformable as the device is pressed, usually vertically downwards, onto the valve assembly. In contrast, this embodiment of the invention requires only half the deformation which is required of conventional lug arrangements, to provide the same strength of attachment. Further, the nose and tail portions may, because of the mode of attachment, be of dimensions which permit much fuller seating into the channel than has hitherto been possible with conventional lug arrangements.

When the device is moulded in the manner described above each of the nose and tail portions is effectively formed in the two halves of the mould cavity which means that the nose is split, as is the tail. This is advantageous since it means that when the moulding is folded together there is a certain amount of resilience in the nose and tail respectively, by virtue of the two halves of each portion being forced together. This is in addition to the natural resilience of the material from which the moulding is formed, and so assists the grip of the nose and tail portions into the channel of the dispenser when the device is in the attached configuration. Preferably the moulding is such that one half of the nose, and one half of the tail, is provided with a pin, and the other respective halves are provided with a hole to suit so that when the moulding is folded, no relative motion between the matching halves is permitted other than the slight springing apart which, as has been described above, assists grip in the channel.

For a better understanding of the invention and to show how the same may be carried into effect, reference will now be made, by way of example, to the accompanying drawings in which.

Figure 1:
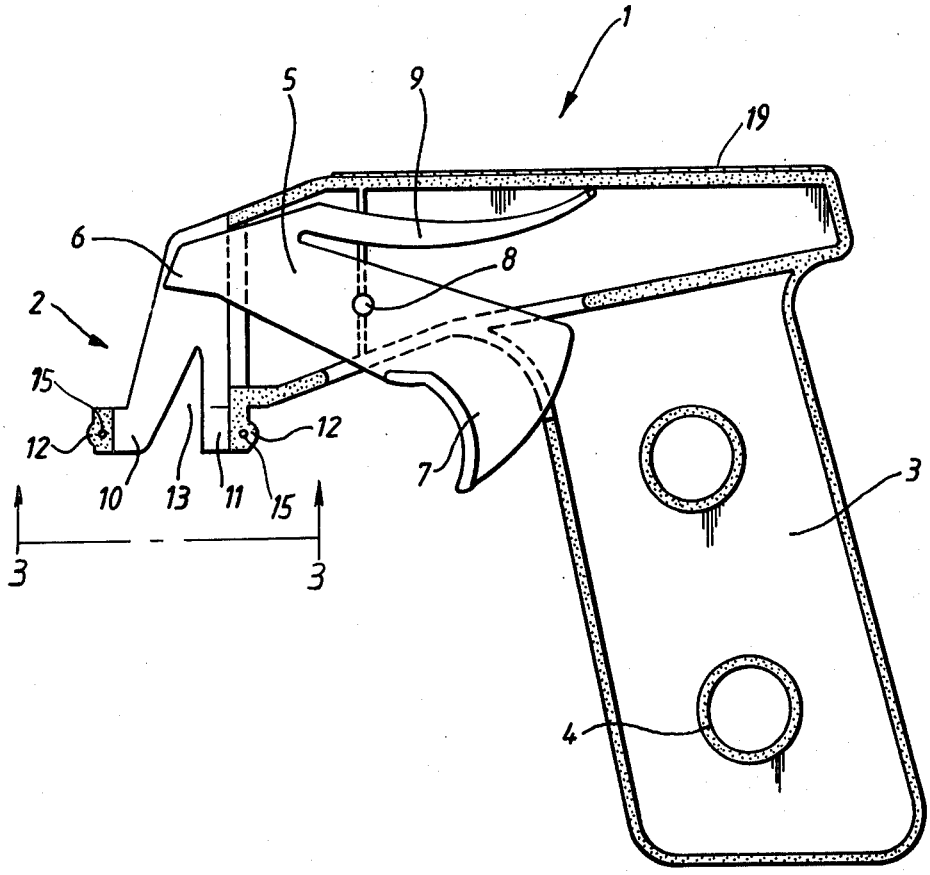
FIG. 1 is a vertical cross-section through an embodiment of the invention.
Figure 4:
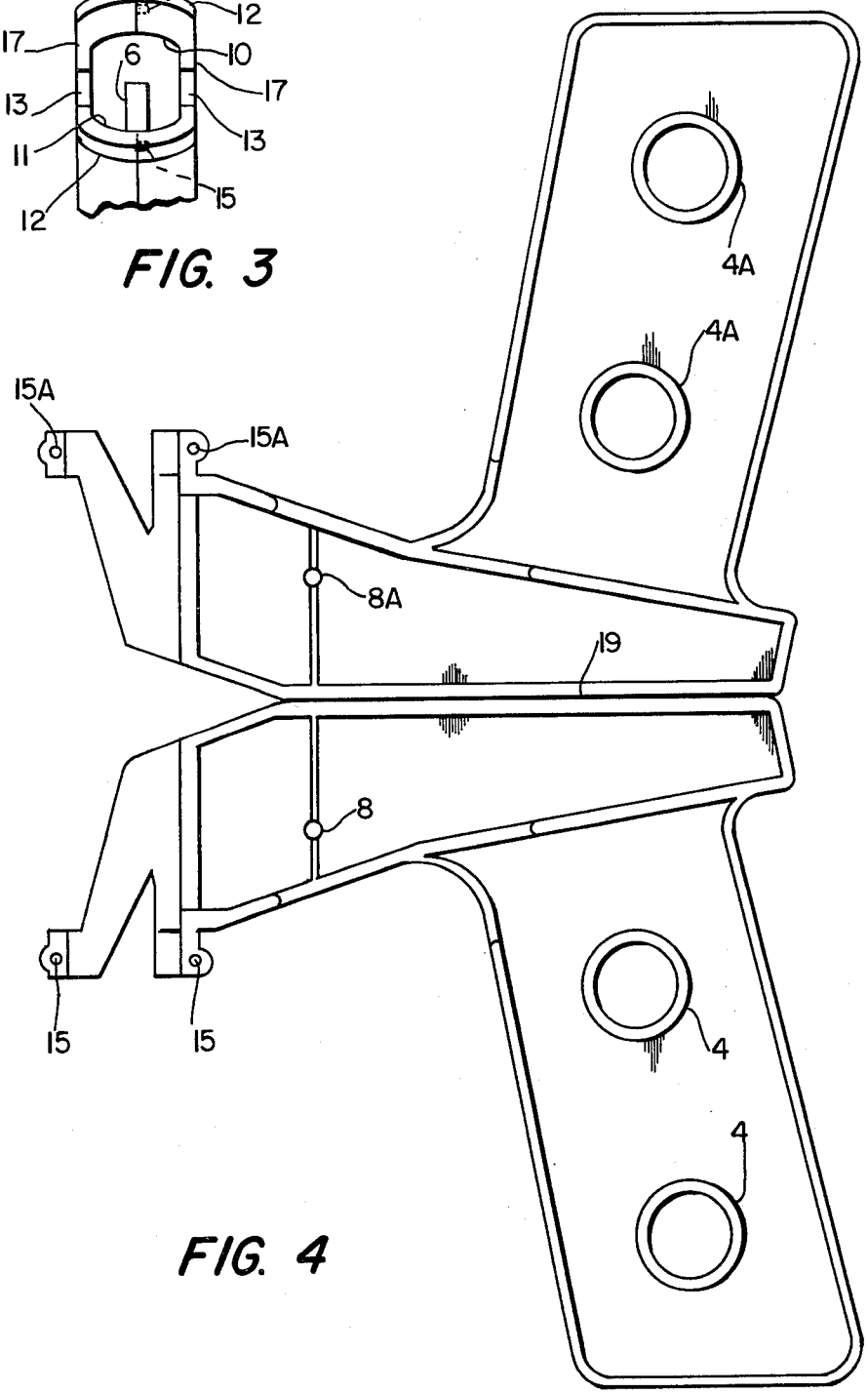
FIG. 4 shows the "butterfly" molding which is folded to form the body of FIG. 1.

Referring to FIG. 1 there is shown a device according to the invention having a body 1 including a portion 2 adapted for coupling to a pressurised dispenser and a handle 3. The handle, which is intended to be gripped in the hand of the user, is provided internally with cooperating portions in the form of press-studs 4 which snap together to aid assembly of the body. Indeed, as shown in FIG. 4, in the embodiment shown the body is moulded as a single item in the form of mirror image halves joined at the upper edge 19 in a "butterfly" configuration. To produce the body the butterfly is folded along the joined edge and the co-operating portions 4 are snapped together to secure the two halves of the body together. Referring to FIG. 1, since this figure illustrates the body along the mid plane where the two halves meeet, the raised, touching portions are not cut and not shown as cross hatching, except at the top edge along which the molding was folded. For illustrative purposes, the "raised" parts of the mold half shown in FIG. 1 which touch the other half are shown spackled. Although the two halves of FIG. 4 are described as "mirror images", it is of course understood that there are deviations therefrom. Specifically the studs of one half will be smaller than the studs of the other half so as to snap thereinto. The pin 8 need be formed in one side only, abutting the surface 8A in the other half. And the pins 15 in the nose portion 10 and the tail portion 11 of one half will mate with holes 15A of the other half.

The device includes an actuating means which is operable to depress or release the actuating member of the dispenser to which the device is intended for attachment, which actuating means comprises a lever 5 having one end 6 which, in use, is in contact with the actuating member of the dispenser, and an opposite end 7 in the form of a trigger extending outside the body. The lever 5 is pivotally mounted at pivot point 8 within the body of the device, the pivot point being constituted by a pin formed on one half of the body during the moulding procedure.

In use the hand of the user grips the handle 3 and the index finger passes around the trigger 7. The application of pressure by pulling the trigger 7 causes the lever 5 to pivot about point 8 and hence causes depression of the end 6 and thus of the actuating member of the dispenser. The actuating member of the dispenser is, as is well known, effectively spring loaded by the pressure contained within the dispenser. Thus when attached to a dispenser, release of the trigger 7 will automatically mean that the actuating member moves upwards against the end 6 and hence the lever 5 pivots back into the "inoperative" position of the trigger. However when the device is not attached to a dispenser, the trigger 7 apparently flaps freely adjacent the handle. Thus for reasons of appearance the embodiment shown includes a spring for reaction against the body. The spring is in the form of a resilient strip 9 integral with and extending from the lever 5 to the upper portion of the body; this effectively maintains the trigger in the "inoperative" position when the device is not attached to a dispenser and, of course, when the trigger is not being pulled by the user.

Figure 3:
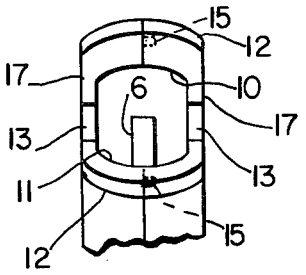
FIG. 3 is a view from beneath the nose portion of FIG. 1, taken along line 3—3 of FIG. 1.

Referring to FIGS. 1 and 3 the portion 2 adapted for coupling to the dispenser comprises a nose portion 10 and a tail portion 11. Each of these two portions has a lip 12 to suit an annular channel opening towards the actuating member of a dispenser to which attachment is intended. The nose and/or tail portions are resiliently deformable and are shaped such as to be engageable in substantially diametrically opposed regions of the channel. Deformation of the nose and/or tail portions is permitted, apart from the natural resilience of the polypropylene from which the illustrated embodiment is formed, by means of an effectively cantilevered configuration, the two components of the cantilever being spaced by a channel 13 in the flat sides 17 of the nose and tail portions. The portions which in use actually engage the dispenser are part annular to provide good grip with the valve assembly. The embodiment shown is formed by a "butterfly" moulding process, and so necessarily the body is in two sections linked across a common "spine" 19, as shown in FIG. 4. One section of each of the nose and tail portions has a moulded pin, 15 and the other section has a mating hole 15A; the pin 15 in the hole 15A prevents movement in the member once the fold along the "spine" 19 has been made, thus conferring a degree of rigidity on the respective nose and tail portions which may not be present before assembly is completed.

Figure 2:
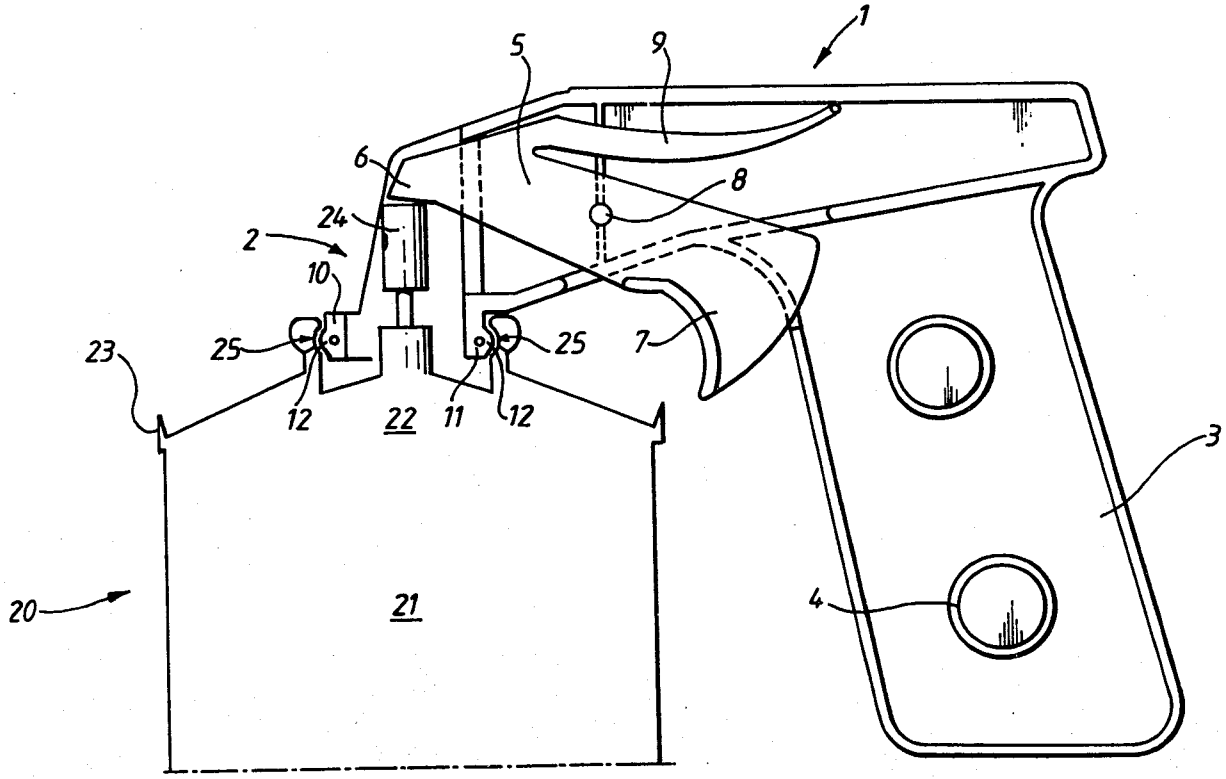
FIG. 2 shows the device of FIG. 1 in combination with a pressurised dispenser.

Use of the embodiment shown in FIG. 1 is illustrated in FIG. 2, which shows the device 1 attached to a pressurized dispenser 20 comprising a container 21 and a valve arrangement 22. For clarity, a part of the coupling means of the device has been omitted. The dispenser has a conventional upper shoulder 23. The valve section of the dispenser includes an actuating member 24, that is the conventional button which is usually depressed by the index finger in operation of the dispenser, and an annular channel 25 which opens inwardly towards the actuating member. The device is attached to the dispenser by virtue of co-operation between the lips 12 of the nose portion 10 and tail portion 11, and the walls of the channel 25. In attaching the device to the dispenser, the nose portion 10 is first inserted completely into the appropriate part of the channel 25 without the need for any deformation to take place. Thereafter the device is pivotted about the nose portion 10 with respect to the dispenser until the tail portion 11 is "snapped" into a diametrically opposed portion of the channel 25, by virtue of its resilient deformation. Detachment of the device from the dispenser is the reverse of this operation. As may be seen from FIG. 2, pressure on the trigger 7 will cause the lever end 6 to move downwards and hence to depress the actuating member of the dispenser and release a spray of the pressurised active ingredient contained in the dispenser through the open front of the device.

As is mentioned above, the device shown in the drawings is formed from plastics materials such as polypropylene or nylon, by a "butterfly" moulding technique, and so may have constructional aids and strengthening members which are not shown. It is not essential that the material from which the trigger is moulded should be the same as that of the body. The stiffness of the sections constituting the nose and/or tail portions is such that they are resilient enough to permit coupling in the manner described, and rigid enough to permit supportive attachment as required. Indeed the embodiment shown is of a configuration and rigidity such as permits ready attachment to a dispenser whilst using only one hand, and also may be supportively attached to conventional dispensers even allowing for the range of tolerance in the size of valve assemblies which are usually supplied to the market.

I claim:

1. A combined handle and actuating device for a pressurised dispenser of the kind comprising a container containing a pressurised active ingredient and having a discharge valve assembly manually operable by a depressable actuating member, the valve assembly including an annular channel which opens towards the actuating member, which device comprises a body having a handle to be gripped by the user and coupling means adapted for ready supportive attachment to and detachment from the dispenser, and an actuating means operable by the hand of the user holding the handle to depress or release the actuating member, wherein:

the coupling means is made of resiliently deformable plastics material and comprises a part annular nose portion and a part annular tail portion diametrically opposed relative thereto so as to be engageable with respective diametrically opposed regions of said channel, and a cantilever connecting means connecting said nose portion to said body downwardly and forwardly to permit resilient deformation of the nose portion relative to the body, diametrically opposed peripheral recesses arranged in the coupling means between the nose portion and the tail portion in order to define said cantilever connection of the nose portion to said body downwardly and forwardly which renders the nose portion more readily deformable than the tail portion, the device being attachable to the dispenser via said coupling means by first inserting the nose portion fully into a region of said channel followed by relative pivotting of the device about the nose portion accompanied by resilient deformation of the nose portion so as to bring the tail portion into snap-fitting engagement with a substantially diametrically opposed region of the channel.

2. A device according to claim 1, wherein said body and said coupling portion are formed by a pair of matching components, said components including co-operating portions and being secured together by snap-engagement of said co-operating portions.

3. A device according to claim 2, wherein said matching components are formed as a one-piece plastics moulding.

4. A device according to claim 2, wherein said co-operating portions are disposed in the handle of the device.

5. A device according to claim 1, wherein the nose portion and the tail portion are split along a diametral plane, thereby to impart resilient deformability to said portions.

6. A device according to claim 1, wherein the actuating means comprises a lever pivotally mounted in the body, one end of the lever extending out of the body to form a trigger and the other end, when the device is attached to the dispenser, engaging the actuating member such that pulling of the trigger causes the lever to pivot and to depress the actuating member.

7. A device according to claim 6, wherein the lever is provided with a spring for reaction against the body to maintain the trigger in an inoperative position when the device is not attached to the dispenser and when the trigger is not being pulled by the user.

8. A device according to claim 1, wherein the body and the coupling portion are made of polypropylene.

9. A device according to claim 3, wherein the actuating means comprises a lever pivotally mounted in the body and wherein the moulding includes a pin which constitutes the pivot about which the lever is pivotally mounted in the body.

10. A device according to claim 3, wherein the parts of the moulding which, when assembled, contitute the nose portion, are provided respectively with a pin and a co-operating hole such that in the assembled configuration relative movement of the sections lateral of the pin is substantially prevented.

11. A device according to claim 3, wherein the parts of the moulding which, when assembled, constitute the tail portion, are provided respectively with a pin and a co-operating hole such that in the assembled configuration relative movement of the sections lateral of the pin is substantially prevented.

12. A device according to claim 1, wherein the body is in the form of a two-part plastics moulding comprising two matching components which include co-operating portions and are secured together by snap engagement of said co-operating portions.

* * * * *